United States Patent [19]

Cooper

[11] Patent Number: 4,860,943

[45] Date of Patent: Aug. 29, 1989

[54] WRAP-AROUND CARTON LOCKING MEANS

[75] Inventor: Leonard M. Cooper, West Monroe, La.

[73] Assignee: Manville Corporation, Denver, Colo.

[21] Appl. No.: 187,810

[22] Filed: Apr. 29, 1988

[51] Int. Cl.[4] ..... B65D 75/06

[52] U.S. Cl. ..... 229/40; 206/140; 206/427

[58] Field of Search ..... 229/40; 206/427, 434, 206/140

[56] References Cited

U.S. PATENT DOCUMENTS

| | | | |
|---|---|---|---|
| 2,798,603 | 7/1957 | Grinspoon | 206/140 |
| 3,398,856 | 8/1968 | Graser | 229/40 |
| 4,437,606 | 3/1984 | Graser | 229/40 |
| 4,597,523 | 7/1986 | Schuster | 229/40 |
| 4,611,754 | 9/1986 | Sutherland | 229/40 |

FOREIGN PATENT DOCUMENTS

| | | | |
|---|---|---|---|
| 566478 | 8/1956 | Italy | 229/40 |
| 1376597 | 12/1974 | United Kingdom | 229/40 |

*Primary Examiner*—Gary Elkins
*Attorney, Agent, or Firm*—John D. Lister

[57] ABSTRACT

A carbon having a bottom panel comprised of two overlapping flaps. The outer flap has a primary male tab engaging a primary female locking edge in the inner flap, while the inner flap has a secondary male locking tab engaging a secondary female locking opening in the outer flap. The secondary locking tab is connected to the carbon along a fold line coinciding with the fold line connecting the inner flap to the adjacent side panel, allowing a large secondary locking tab to be used even though the bottom panel is narrow. The outer and inner flaps are able to overlap across substantially the full width of the flaps to form a bottom panel of double thickness.

14 Claims, 2 Drawing Sheets

FIG. 1
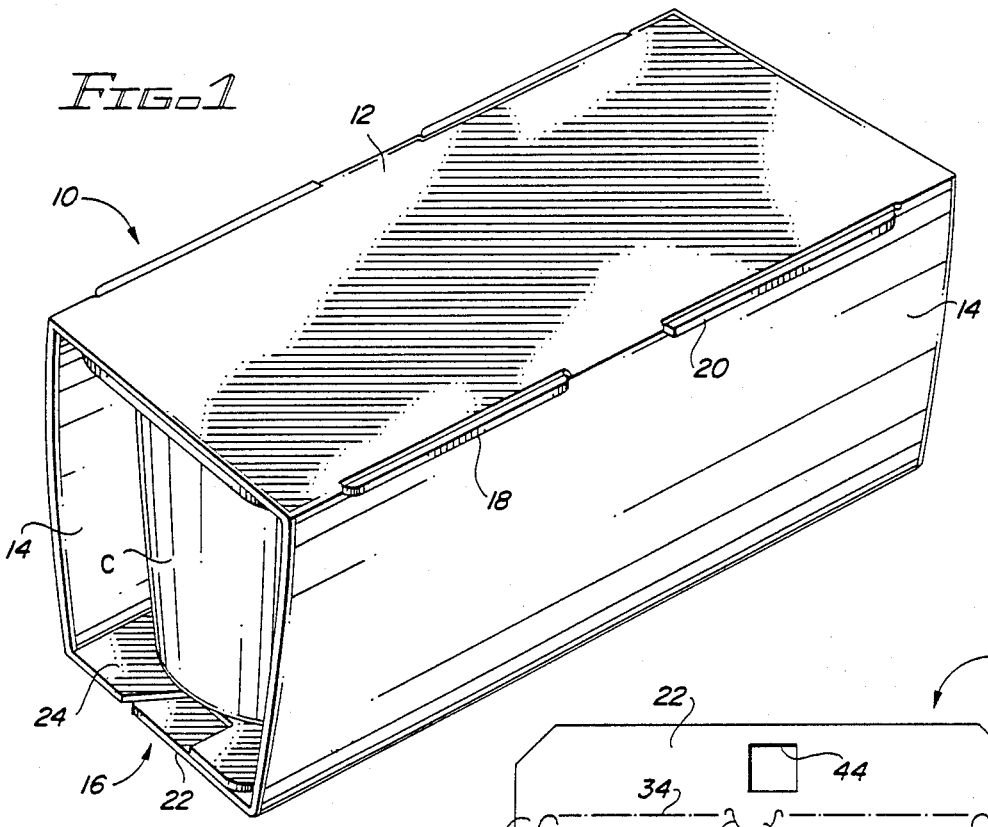
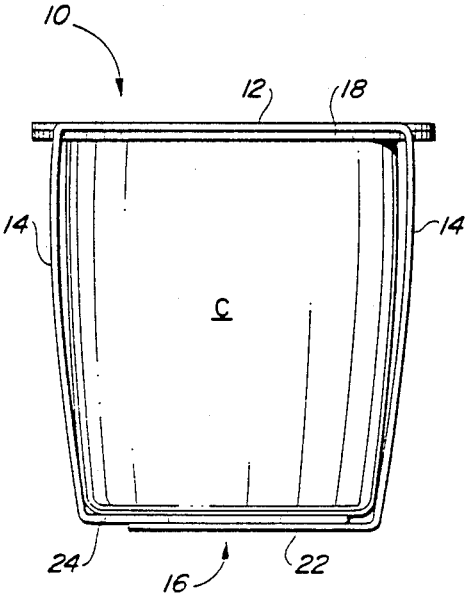
FIG. 2
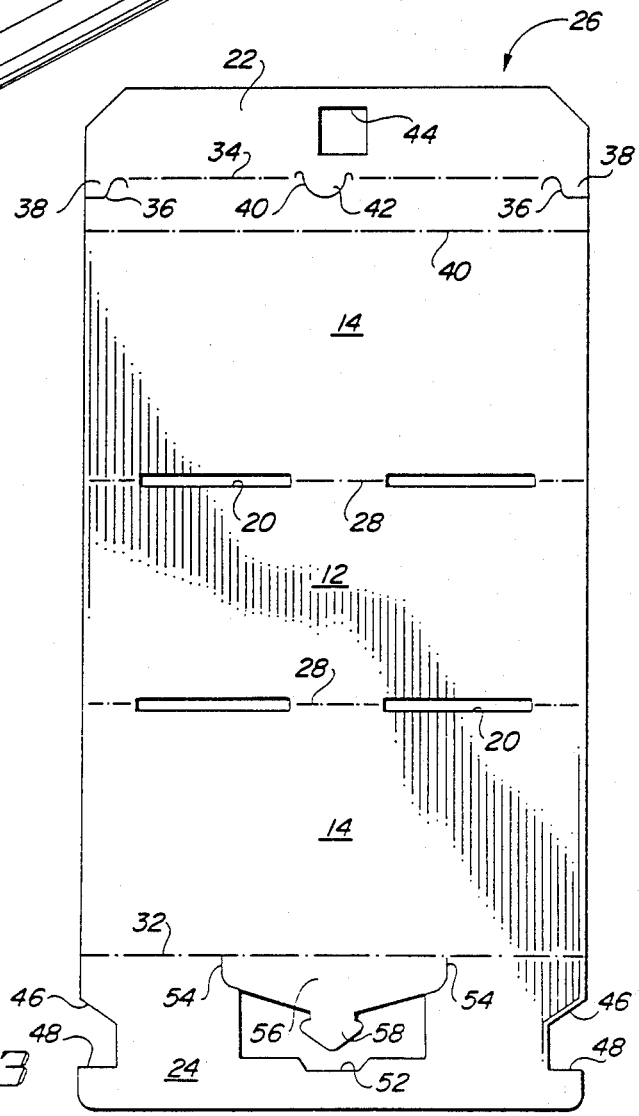
FIG. 3

FIG. 4
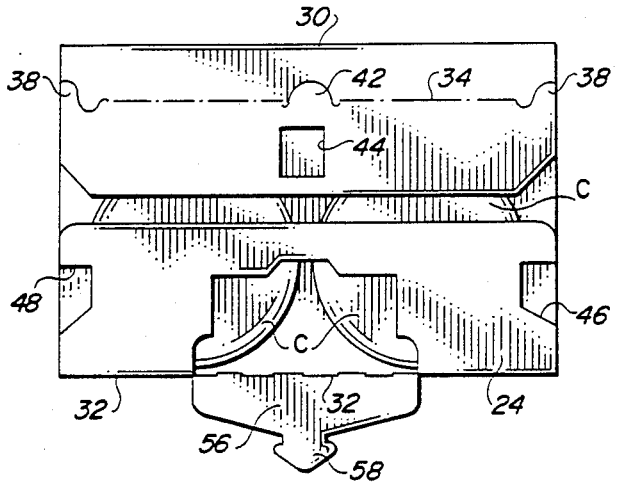
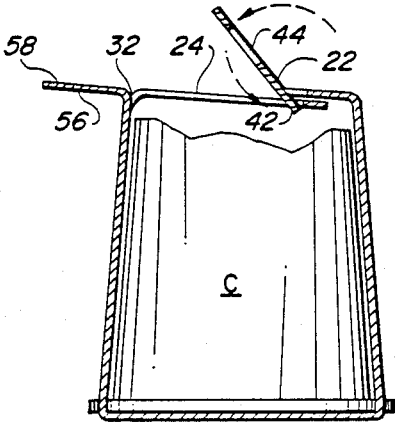
FIG. 5A
FIG. 5
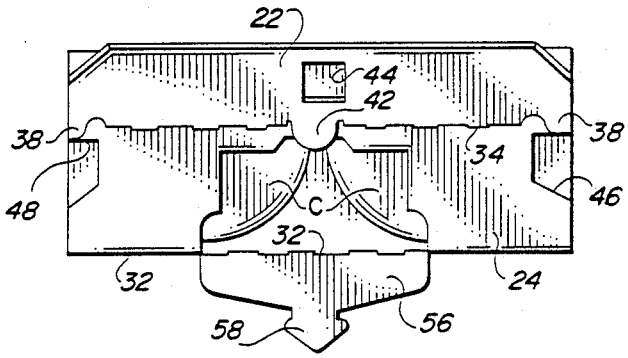
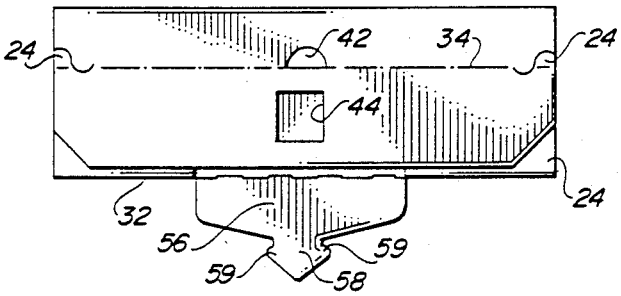
FIG. 6
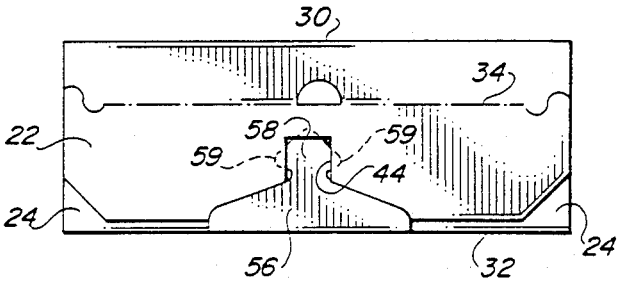
FIG. 7

WRAP-AROUND CARTON LOCKING MEANS

FIELD OF THE INVENTION

This invention relates to cartons which have a panel formed from interlocking overlapping panel flaps. More particularly, it relates to the locking mechanism for holding the panel flaps in locked condition.

BACKGROUND OF THE INVENTION

Articles of various types are commonly packaged in wrap-around cartons. In the packaging process, rapidly moving articles and carton blanks are brought together in a packaging machine and the blank is wrapped or formed about the articles while moving through the machine at very high rates of speed. One of the panels of the carton, typically the bottom panel, is formed by overlapping the end portions of the blank and connecting them together by integral locking mechanisms. An example of such an arrangement can be found in U.S. Pat. No. 4,437,606 to Graser, which discloses primary, secondary and tertiary locking elements to connect the panel flaps and prevent them from disengaging. The primary male locking tab is on the outer or overlying flap and engages with a female locking edge in the inner or underlying flap. The secondary locking tab, which guards against withdrawal of the primary locking tab, is connected to the inner flap but overlies the edge portion of the outer flap as it extends into a female locking opening in the outer flap.

The locking arrangement in the Graser patent works well in connection with beverage bottle carriers, or with any carton arrangement in which the panel formed from the overlapping panel flaps is relatively wide. This is because the various locking elements can be properly located and sufficiently spaced apart to allow the flaps and the locking elements carried thereby to be manipulated by the packaging machine into locking engagement. When forming a more narrow carton, however, the same situation does not obtain. In smaller cartons such as those used to package plastic food tubs, the panels are smaller and do not provide as much area in which to locate similar locking elements. Furthermore, due to the tapered shape of may food tubs, the bottom panel of these smaller cartons is often narrower than the top panel, making it even more difficult to provide suitable locking means.

An apparent solution to the problem would appear to merely require reducing the size of the locking elements in order to be able to locate them on the available surface area of the panel flaps. This sould not be satisfactory, howwever, because it would weaken the panel comprised of the connected laps. All other things being equal, smaller locking elements are not able to resist the amount of stress that larger elements can resist. On the other hand, since the basic type of locking arrangement disclosed in the Graser patent has been found to perform well, it would be desirable to be able to use related locking elements in smaller cartons to avoid the need to develop entirely new designs.

SUMMARY OF THE INVENTION

This invention provides overlapping flaps which are connected to adjacent panels along fold lines. The outer flap contains a female locking opening and the inner flap has a male locking member engaging the female locking opening. The male locking member is connected to the carton along a fold line substantially aligned with the fold line connecting the inner flap to its adjacent panel. With this arrangement the male locking member, which may comprise a punch-style arrow-shaped tab, can be quite large compared to the combined width of the overlapped flaps, thus providing more holding power than would ordinarily be possible in a small panel comprised of overlapped flaps.

The engaged male locking member and female opening may be the secondary locks used in conjunction with a set of primary locks. Thus the outer flap may have a male locking member located between the female locking opening and the fold line connecting the outer flap to its adjacent panel, and the inner flap may contain a female locking edge located between the male locking member of the inner flap and the free edge of the inner flap. The male locking member of the outer flap in such case would engage the female locking edge of the inner flap, and they would constitute the primary locking members.

With the locking arrangement of the invention the overlapped portions of the inner and outer flaps may comprise a major portion of the width of the panel formed by the flaps, resulting in a panel of double thickness throughout most of its width.

Other features and aspects of the invention, as well as other benefits of the invention, will be ascertained in the more detailed description of the invention which follows.

BRIEF DESCRIPTION OF THE DRAWINGS

FIG. 1 is a pictorial view of a carton which incorporates the locking arrangement of the present invention;

FIG. 2 is an end view of the carton of FIG. 1;

FIG. 3 is a plan view of a production blank used to form a carton incorporating the locking features of the present invention;

FIG. 4 is a bottom view of a partially formed carton prior to engagement of the bottom panel flaps;

FIG. 5 is a view similar to that of FIG. 4, but showing the flaps in their initial stage of assembly;

FIG. 5A is a transverse sectional view of the carton and containers showing the flaps at a stage of asssembly intermediate the stages of FIGS. 5 and 6;

FIG. 6 is a view similar to that of FIG. 5, but showing the flaps in a later stage of assembly; and FIG. 7 is a bottom view of the assembled and locked bottom panel.

DESCRIPTION OF THE INVENTION

Referring to FIGS. 1 and 2, a carton 10, comprised of a top panel 12, side panels 14 and bottom panel 16, contains two food containers C, illustrated as plastic tubs of the type used to package butter, pudding and other soft foods. The edges 18 of the lids of the containers project through cutouts 20 in the upper portion of the side panels 14 to assist in holding the containers in place. The containers C are relatively narrow overall, and in addition have slightly tapered side walls which cause their bottoms to be narrower than their tops. In order for the containers to be tightly held within the carton the bottom panel 16 of the carton is therefore narrower than the top panel. While carton dimensions naturally vary according to the dimensions of the containers, a bottom wall width of less than two inches is not uncommon.

The bottom panel 16 is comprised of two overlapping flaps 22 and 24. Flap 22 is the outer or overlying flap, and flap 24 is the inner or underlying flap. As illustrated, the flaps 22 and 24 overlap each other over a major portion of their width.

Referring to FIG. 3, a blank for forming the carton 10 is indicated at 26 and is comprised of a top panel section 12, side panel sections 14 and bottom panel flaps 22 and 24. The side panel sections 14 are connected to the top panel section 12 along fold lines 28, the outer flap 22 is connected to its adjacent side panel section 14 along fold line 30, and the inner flap 24 is connected to its adjacent side panel section 14 along fold line 32.

The outer bottom panel flap 22 has a score line 34 parallel to and spaced from the fold line 30. The ends of the score line terminate short of the ends of the flap 22 and are connected to the ends of the flap by cuts or slits 36, which form tertiary male locking tabs 38. The central portion of the score line 34 is interrupted by a slit 40 which forms primary locking tab 42. Located between the primary locking tab 42 and the free edge of the flap 22 is a secondary locking opening 44.

Still referring to FIG. 3, the inner flap 24 contains a cutout 46 on each end edge to provide tertiary female locking edges 48 adapted to be engaged by the tertiary locking tabs 38. A centrally located cutout 50 forms primary female locking edge 52 adapted to be engaged by primary locking tab 42. In addition, slits 54 extending from the fold line 32 form the base side edges of secondary male locking tab 56. The tab 56 includes an arrow-shaped punch-style head 58 adapted to engage with the secondary locking opening 44 in the flap 22 and is connected to the carton blank along fold line 32.

Referring now to FIG. 4, the bottom of the carton is shown as it would appear after the side panel sections 14 of the blank have been folded up about containers C and the bottom flaps 22 and 24 have been folded toward each other along their fold lines 30 and 32. As illustrated, the flaps have not yet been connected together but the secondary locking tab 56 has been folded back along the fold line 32 to expose the primary female locking edge 52 in preparation for the locking operation.

As shown in FIG. 5, the next step in the locking process is to fold the flap 22 back along its score line 34 to position the primary locking tab 42 over the primary female locking edge 52 and to position the tertiary locking tabs 38 over the tertiary female locking edges 48. To engage the primary and tertiary tabs with their locking edges the outer flap 22 is folded back down about its score line 34, causing the tabs to slide beneath their associated locking edges, as shown in FIG. 5A. The result of this operation is illustrated in FIG. 6, which shows portions of the inner flap 24 exposed in the areas formerly occupied by the locking tabs 38 and 42, now hidden beneath the female locking edges 48 and 52 of inner flap 24. A very small area of the containers C can still be seen where they have not been covered by the flap 22.

As shown in FIG. 7, the secondary locking tab 56 has been folded back down about the fold line 32 and the arrow-shaped head 58 of the tab has been inserted into the secondary female locking opening 44 of the flap 22. The shoulders 59 on the arrow-shaped head 58 engage the edges of the opening 44 to prevent the tab from being pulled out. Thus the secondary tab prevents the disengagement of the primary locking tab, and the tertiary locking tabs provide further protection against the disengagement of both the primary and secondary locking tabs. As illustrated, the free edge of the outer flap 22 extends substantially all the way to the fold line 32 connecting the flap 24 to its adjacent side panel. A slight distance remains between the free edge of the flap 22 and the fold line 32 to allow for the tab 56 to have room to be maneuvered into locking engagement with the locking opening 44. The free edge of the inner flap 24, although not shown, can extend entirely across the width of the bottom panel so as to terminate substantially at the opposite side panel of the carton. Thus the bottom panel is comprised of a double thickness throughout the major portion of its width due to the substantially full overlap of the flaps 22 and 24.

Because the locking tab member 56 is connected to the carton at the fold line between the inner flap 24 and its adjacent side panel, it need not be made shorter or smaller in order to function propertly, as would have to be done if it were connected to the inner flap at a point intermediate the width of the flap in the manner of the prior art arrangements. Although it is preferred than the fold line connecting the tab member 56 to the carton coincide with the fold line connecting the inner flap and its adjacent side panel, it is possible to locate it slightly out of alignment in either direction and still obtain the benefits of the invention. Such a location would still, however, be considered to be substantially coinciding with the fold line connecting the inner flap and its adjacent side panel.

Although the invention has been described in connection with plastic containers, obviously it would be beneficially used in cartons designed to carry other types of articles. Regardless of the type of article in the carton, the number of articles in the carton, or the specific dimensions of the carton and articles, the invention would be of particular merit whenever it is desired to employ a relatively large locking tab to connect overlapping flaps which form a relatively narrow panel.

It should be understood that the invention need not be confined to use in a carton incorporating primary, secondary and tertiary locking assemblies. Although such an arrangement is preferred from the standpoint of securely holding the overlapping flaps of a carton together, the principles of the invention may apply in carton locking arrangements which do not employ all such assemblies.

It should also be understood that the invention is not necessarily limited to the specific types of locking details described in connection with the preferred embodiment. It should further be understood that changes to certain specific features of the preferred embodiment may be made in the practice of the invention without affecting the overall performance and concept of the inventive locking arrangement and without departing from the spirit and scope of the invention, as defined in the appended claims.

What is claimed is:

1. A carton for holding one or more articles, comprising:

two side panels connected to top and botton panels;

the bottom panel comprising an inner flap connected to one of the side panels along a fold line and an outer flap connected to the other side panel along a fold line, the outer flap overlapping the inner flap;

the outer flap acontaining a female locking opening;

the inner flap having a male locking member engaging the female locking opening; and the male locking member being connected to the carton along a fold line substantially coinciding with the fold line connecting the inner flap to said one side panel.

2. A carton according to claim 1, wherein the male locking member overlies the outer flap between the fold line connecting the male locking member to the carton and the female locking opening.

3. A carton according to claim 1, wherein the outer flap has a male locking member located between the female locking opening and the fold line connecting the outer flap to said other side panel, and wherein the inner flap contains a female locking edge located between the male lockinhg member of the inner flap and the edge of the inner flap opposite the fold line connecting the inner flap to said one side panel, the male locking member of the outer flap engaging the female locking edge of the inner flap.

4. A carton according to claim 3, wherein the male locking member of the outer flap and the female locking edge of the inner flap comprises primary locking members, and the male locking member of the inner flap and the female locking opening of the outer flap comprise secondary locking members.

5. A carton according to claim 4, wherein the outer flap includes a fold line substantially parallel to and spaced from the fold line connecting the outer flap to said other side panel, and wherein the primary male locking member comprises at least one tab connected to the outer flap at points substantially coinciding with said spaced fold line.

6. A carton according to claim 4, wherein the secondary male locking member is a punch-style arrow-shaped tab.

7. A carton according to claim 1, wherein the overlapped portion of the inner and outer flaps comprises a major portion of the width of the bottom panel of the carton.

8. A carton according to claim 7, wherein the width of the top panel is grreater than the width of the bottom panel.

9. A carton according to claim 7, wherein substantially the entire width of the bottom panel of the carton is of double thickness.

10. A carton according to claim 6, wherein the inner and outer flaps of the bottom panel have end edges and wherein the primary and secondary locking members are generally centrally located between the end edges of the bottom panel flaps.

11. A blank for forming a carton for holding one or more articles, comprising:

a generally rectangular sheet of carton material;

the sheet having a central top panel section, side panel sections connected to the top panel section along fold lines, and bottom panel flaps connected to the side panel sections along fold lines;

one of the bottom panel flaps comprising an inner flap and the other bottom panel flap comprising an outer flap, the outer flap adapted to overlap the inner flap in a carton formed from the blank;

the outer flap containing a female locking opening;

the inner flap having a male locking member adapted to engage the female locking member in a carton formed from the blank; and the male locking member being connected to the blank along a fold line substantially coinciding with the fold line connecting the inner flap to the side panel section.

12. A carton blank according to claim 11, wherein the portions of the inner and outer flaps adapted to be overlapped in a carton formd from the blank comprise a maor portion of the bottom panel of such a carton.

13. A carton blank according to claim 12, wherein the width of the top panel section is greater than the width of the bottom panel of a carton formed from the blank.

14. A carton blank according to claim 11, wherein the male locking member overlies the outer flap in a carton formed from the blank between the fold line connecting the male locking member to the carton and the female locking opening.

* * * * *